United States Patent [19]

Earlywine

[11] Patent Number: 4,475,923

[45] Date of Patent: Oct. 9, 1984

[54] CHEMICALLY TREATED KINDLING AND PROCESS

[76] Inventor: Roscoe T. Earlywine, 3100 Field Dr., Kokomo, Ind. 46902

[21] Appl. No.: 461,445

[22] Filed: Jan. 27, 1983

[51] Int. Cl.[3] ..... C10L 11/00; C10L 11/04

[52] U.S. Cl. ..... 44/41; 44/38

[58] Field of Search ..... 44/41, 38, 34

[56] References Cited

U.S. PATENT DOCUMENTS

| | | | |
|---|---|---|---|
| 133,973 | 12/1872 | Everett . | |
| 143,066 | 9/1873 | Crumpton . | |
| 173,721 | 2/1876 | Hathaway . | |
| 747,282 | 12/1903 | Wallgren . | |
| 2,007,694 | 7/1935 | Rutherford . | |
| 2,094,661 | 10/1937 | Macleay et al. | 44/41 |
| 2,381,891 | 8/1945 | Elkan | 44/41 X |
| 2,811,428 | 10/1957 | Smith . | |
| 4,189,305 | 2/1980 | Clayton . | |
| 4,202,669 | 5/1980 | Ball . | |
| 4,308,033 | 12/1981 | Gunnerman . | |
| 4,386,937 | 6/1983 | Fareri et al. | 44/41 |

FOREIGN PATENT DOCUMENTS

| | | | |
|---|---|---|---|
| 114656 | 2/1942 | Australia | 44/41 |
| 195576 | 12/1919 | Canada | 44/41 |
| 1991 | of 1863 | United Kingdom | 44/41 |
| 420716 | 12/1934 | United Kingdom | 44/41 |

*Primary Examiner*—Carl F. Dees

*Attorney, Agent, or Firm*—Jeffers, Irish & Hoffman

[57] ABSTRACT

A chemically treated kindling and process for the production thereof wherein the kindling is comprised of a pressed mixture of wood fibers, alum, and cornstarch, and is saturated with a prepared composition comprising a plurality of chemically distinct compositions, each of the compositions containing a different predetermined amount of refined petroleum wax and refined oil.

13 Claims, 2 Drawing Figures

CHEMICALLY TREATED KINDLING AND PROCESS

BACKGROUND OF THE INVENTION

This invention pertains to kindling, and more particularly to chemically treated kindling and a process for the production thereof.

Currently, various types of fire kindlers are available for use in starting fires in home fireplaces, charcoal grills, campfires, and the like. Some of these fire kindlers are suitable for starting fires if there is no wind or gusts, or if the material to be burned, for example, wood or charcoal briquettes, is dry or has been recently cut or purchased, respectively. If such is the case, the user generally is required to apply a liquid flammable such as kerosene or charcoal lighter in aiding the ignition of the fire kindler to start the fire. Obviously, these particular fire kindlers are undesirable if an outside fire is intended to be started in windy conditions, the material to be burned is wet, or relatively old. In addition, the necessity of having to use a flammable liquid presents a hazard to the user and those around him.

Generally, fire kindlers are made of a combustible material coated or saturated with one or a combination of various substances, for example, rosin, tallow, varnish, turpentine, and the like. These fire kindlers may not only burn too rapidly to start a fire, but some are toxic, thereby rendering them a potential hazard to small children. Further, these fire kindlers also possess a distinct smell or odor, either before or during burning, which leaves an undesirable odor in the home or may leave a peculiar taste to the food cooked by the fire started therewith.

Other fire kindlers, besides being coated or saturated with the above or similar substances, are coated on their outer surfaces with sawdust or like materials to increase their kindling characteristics. However, these loose coatings of sawdust and like materials are messy, and generally do not remain adhered to the outer surface over long periods of time, thereby diminishing their fire starting capability.

Further undesirable characteristics associated with other fire kindlers are that they are designed to ignite quickly and burn rapidly, which is satisfactory in no-wind conditions or with combustible material which is dry. Should wind conditions exist or the combustible material be wet or otherwise hard to burn, a large volume of fire kindler is required to begin the fire. Also, some fire kindlers require an aid in assisting their ignition, such as a wick or other type of lighting aid.

Other disadvantages may exist with fire kindlers, particularly when the fire is intended to be started outside in adverse weather conditions, in that they will not light or stay lit when wet from rain or snow. Again, this is an undesirable feature for outdoor campers, ice fishermen, and other outdoor sportsmen.

Attempts have been made to increase the fire kindling characteristics, particularly for use in outdoor adverse weather conditions. One such attempt is to coat or saturate the fire kindler with a flammable material or substance which will, upon being heated, drip and fall on the combustible material to be burned and on the bottom surface of the container containing the combustible material, for example, the bottom of a charcoal grill. The drippings then ignite to assist in starting the fire.

A particularly disadvantageous feature associated with fire kindlers utilizing drippings of flammable material is that some of the drippings may not ignite during the existence of the fire, and will then pose potential fire hazards later on, especially if some of the drippings should fall on clothing or other objects or equipment.

In view of the above disadvantages, it is clear that there still exists a need for improved fire kindling.

SUMMARY OF THE INVENTION

The present invention overcomes the disadvantages of prior art fire kindling by providing an improved fire kindling and a process for the production thereof.

The kindling of the present invention is saturated with a novel composition which renders the kindling not only inoffensive to smell and non-toxic, but also easily lit in various adverse weather conditions. The kindling of the present invention is easily lit and remains lit in both rainy and windy conditions. Additionally, once wet, the kindling of the present invention is easily relit for subsequent use.

Further, due to the novel composition with which the kindling is saturated, the kindling burns at a controlled rate and requires no other means in assisting its ignition, for example, a wick or the like, and will ignite not only along its edge portions, but also its flat surface areas.

Further desirable features of the fire kindling of the present invention is that the novel composition does not and is not intended to drip while burning, but rather burns to a biodegradable ash. Shelf-life of the fire kindling is indefinite since the composition with which it is saturated does not readily decompose.

The fire kindling of the present invention is intended to be used in starting campfires, fires in home fireplaces and wood burning stoves, in survival kits, and as flares. The uses enumerated are intended to be exemplary only and not limitative to the present invention.

In one form of the invention, there is provided an improved fire kindling comprising a combustible material saturated with a novel composition of refined petroleum wax and refined oil. The process for producing the fire kindling of the present invention comprises the steps of providing three compositions, each comprising specific and different amounts of refined petroleum wax and refined oil from the others. The three compositions are heated to melted liquid states and then mixed together to form a mixture thereof. Separately provided are five other compositions, each comprising specific and different amounts of refined petroleum wax and refined oil. These five compositions are heated to melted liquid states and then mixed together to form a mixture thereof. Thereafter, the melted mixed compositions are blended to form the final composition, and a combustible material is then immersed in the final composition. Thereafter, the combustible material is removed as the chemically treated kindling of the present invention.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
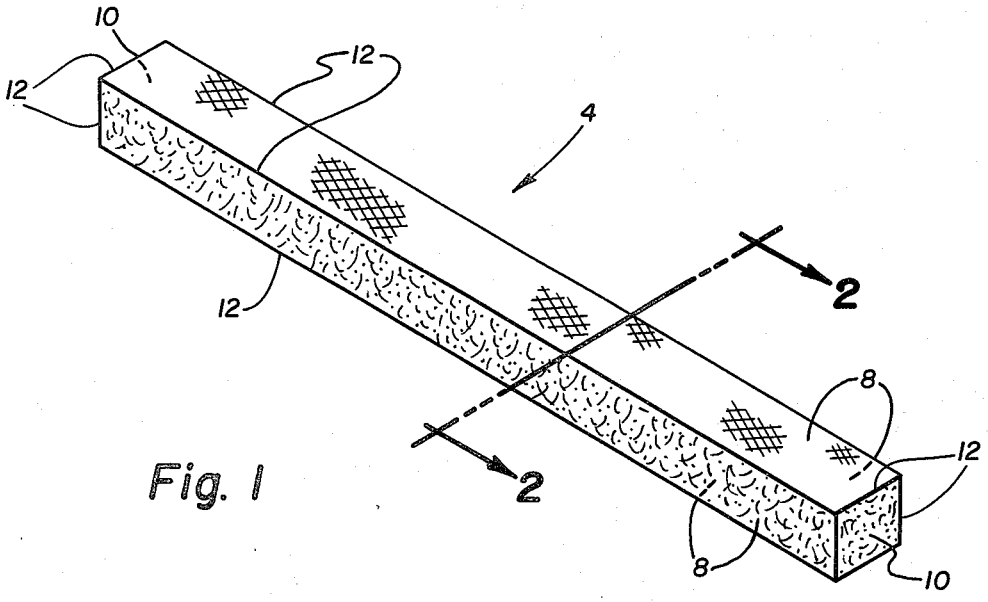
FIG. 1 is a perspective view of a preferred embodiment of the present invention.
Figure 2:
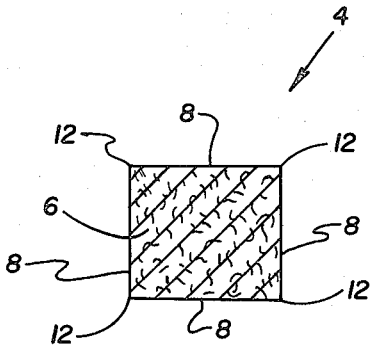
FIG. 2 is a sectional view of FIG. 1 taken along line 2—2 and viewed in the direction of the arrows.

Referring to the figures, chemically treated kindling 4 of the present invention is illustrated, and as can be seen is generally rectangular in shape. Kindling 4 is made of a combustible material, and one such useful material is wood. It is preferred, however, that kindling 4 be made of wood fiber material pressed into the shape illustrated. Further, kindling 4 is optimally made of a mixture of 92% wood fiber, 4% alum, and 4% cornstarch pressed into the shape depicted in FIG. 1. By forming kindling 4 of pressed fiber wood material, it is generally more porous than is solid wood and is therefore more easily saturated, as hereinafter disclosed. The alum and cornstarch aid in maintaining the rigidity of shape of kindling 4, and retaining the composition saturated therein. The wood fiber is preferably a soft wood fiber, for example, pine or cedar fiber. Although it is preferred that kindling 4 be made of a pressed mixture of 92% by weight wood fiber, 4% by weight alum, and 4% by weight cornstarch, it is to be understood that these percentages are not limitative.

The chemical composition with which kindling 4 is saturated is a mixture of eight chemically different compositions. In the descriptions to follow of the eight compositions, the percentages given are to be understood to be weight percentages based on the total weight of each individual composition. The first composition is about 99% refined petroleum wax and about 1% refined oil, and contains not more than 15 parts per million of food grade dibutylparacresol as an antioxidant, which inhibits oxidation. The following are physical characteristics of the first composition:

| | |
|---|---|
| Boiling point | above 600° F. |
| Vapor pressure | less than 0.1 mm Hg at 100° F. |
| Specific gravity | 0.82–0.84 |
| Flash point | 390° F. to 430° F. |

The second composition is about 87% refined petroleum wax and about 13% refined oil, and permits kindling 4 to be lit and to burn in rain or wet condition. The following are physical characteristics of the second composition:

| | |
|---|---|
| Melting point | 128° F. |
| Oil content | 0.13 |

The third composition is about 80% refined petroleum wax and about 20% refined oil, and serves to control the burning rate of kindling 4, thereby increasing its burn time. The following are physical characteristics of the third composition:

| | |
|---|---|
| Melting point | 132° F. |
| Flash point | 415° F. |

The fourth composition is about 75% refined petroleum wax and about 25% refined oil, and during the burning of kindling 4 provides high temperatures. The following are physical characteristics of the fourth composition:

| | |
|---|---|
| Melting point | 144° F. |

-continued

| | |
|---|---|
| Flash point | 435° F. |

The fifth composition is about 70% refined petroleum wax and about 30% refined oil, and like the second composition serves to aid the lighting of kindling 4 in wet conditions. The following are physical characteristics of the fifth composition:

| | |
|---|---|
| Melting point | 115° F. |
| Specific gravity | 0.801 |
| Flash point | 440° F. |

The sixth composition is about 95% refined petroleum wax and about 5% refined oil, and during the burning of kindling 4 provides an increase in heat energy. The following are physical characteristics of the sixth composition:

| | |
|---|---|
| Melting point | 94° F. |
| Specific gravity | 0.81 |
| Flash point | 390° F. |

The sixth composition also contains a trace amount of butylated hydroxytoluene (BHT) as an antioxidant.

The seventh composition is about 99% refined petroleum wax and 1% refined oil, and provides kindling 4 with the ability to continue to burn in windy or gusty conditions. The following are physical characteristics of the seventh composition:

| | |
|---|---|
| Flash point | 390° F. |
| Melting point | 139° F. |

Finally, the eighth composition is about 72% refined petroleum wax and about 28% refined oil and also serves to increase the heat energy during the burning of kindling 4. The following are physical characteristics of the eighth composition:

| | |
|---|---|
| Melting point | 125° F. |
| Flash point | 420° F. |
| Specific gravity | 0.847 |

The different characteristics provided kindling 4 by the eight chemically different compositions, for example, increased burn time, capability of being lit and to burn in wet or windy conditions, is dependent upon the percentage weight of refined petroleum wax and refined oil in each composition. Further, the eight compositions satisfy the standards of 21 C.F.R., Food and Drugs. For example, the refined petroleum wax is a mixture of solid hydrocarbons, paraffinic in nature, conventionally derived from a petroleum, such as by distilling Pennsylvania crude, and refined to meet the specifications prescribed in 21 C.F.R. 172.886. The refined oil can be a mineral oil of virgin petroleum distillates refined to meet the specifications prescribed in 21 C.F.R. 178.3620.

The process of producing kindling 4 comprises heating the first three compositions to melted liquid states and then thoroughly mixing them together for about 20 minutes at a temperature between about 165° F. to about 172° F. The remaining five compositions are heated separate from the first three compositions to melted liquid states and thoroughly mixed together for a period of about 35 minutes at a temperature between about 165° F. and 172° F. Thereafter, the two mixtures of the eight compositions are blended together for about five to ten minutes at a temperature range between about 165° F. and 172° F. Throughout the process, all of the compositions are continuously mixed within the given temperature range. The percentage by weight of each composition based on the total weight of the final composition is:

| | |
|---|---|
| First composition | 38% |
| Second composition | 17% |
| Third composition | 25% |
| Fourth composition | 4% |
| Fifth composition | 4% |
| Sixth composition | 4% |
| Seventh composition | 4% |
| Eighth composition | 4% |

After the compositions have been blended together for about five to ten minutes, kindling 4 is immersed in the final blended composition for about four to five seconds and then withdrawn and allowed to cool as the final product. Because kindling 4 comprises about 92% wood fiber, 4% alum, and 4% cornstarch in pressed form, saturation of kindling 4 is completed during the four to five second period. However, if the percentages by weight of wood fiber, alum, and cornstarch are varied or if a different combustible material is utilized, the immersion time will accordingly vary to insure complete saturation.

Although the above temperatures and times are preferred in the process of producing kindling 4, they may be varied in the process to produce kindling 4, however, the characteristics will accordingly vary.

It is also preferred that kindling 4 be elongate in shape having a length of approximately six inches and a square cross section with each side being approximately a half inch in length. This shape has been found to permit kindling 4 to be saturated by the above final blended composition after about four to five seconds of immersion. Upon being removed from the composition kindling 4 is thoroughly saturated within its interior 6 and on its surfaces 8 and ends 10.

As described above, kindling 4 may be easily lit and burned by applying a flame along its edges 12, surfaces 8 or ends 10 and needs no other means to assist in the ignition thereof. When burning, kindling 4 produces high heat energy output, burns to biodegradable ash with no drippings, and burns at a controlled rate of about seven to ten minutes for each kindling 4 having the above described dimensions.

Further, kindling 4 is virtually odorless when burning, and continues to burn when wet, in rain, and in windy or gusty conditions, yet may be easily extinguished by the user blowing on the flame of kindling 4.

Kindling 4 has numerous uses and only a few examples are campfires, home fireplaces and wood burning stoves, in survival kits, as flares, and the like. Fires are quickly started by breaking kindling 4 into smaller individual pieces and scattering the pieces throughout the material to be burned, and thereafter lighting the broken individual pieces. Kindling 4 further has indefinite shelf-life due to the composition not readily decomposing over an extended period of time.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A process for producing a chemically treated kindling for starting fires, comprising the steps of:

providing a plurality of compositions, each composition containing a different predetermined amount by weight of refined petroleum wax and refined oil than the other compositions, the plurality of compositions being a first composition consisting essentially of about 99% refined petroleum wax, about 1% refined oil, and not more than 15 parts per million of dibutylparacresol as an antioxidant; a second composition consisting essentially of about 87% refined petroleum wax and about 13% refined oil; a third composition consisting essentially of about 80% refined petroleum wax and about 20% refined oil; a fourth composition consisting essentially of about 75% refined petroleum wax and about 25% refined oil; a fifth composition consisting essentially of about 70% refined petroleum wax and about 30% refined oil; a six composition consisting essentially of about 95% refined petroleum wax and about 5% refined oil; a seventh composition consisting essentially of about 99% refined petroleum wax and about 1% refined oil; and an eight composition consisting essentially of about 72% refined petroleum wax and about 28% refined oil, heating the compositions to melted liquid states, mixing the liquid compositions together, immersing a combustible material in the mixed liquid composition, the combustible material being a pressed, shaped solid of about 92% by weight wood fiber, about 4% by weight alum, and about 4% by weight cornstarch, and removing the immersed combustible material as said chemically treated kindling.

2. The process of claim 1 wherein the percentages by weight of the eight compositions based on the total weight thereof are about 38% of the first composition, about 17% of the second composition, about 25% of the third composition, about 4% of the fourth composition, about 4% of the fifth composition, about 4% of the sixth composition, about 4% of the seventh composition, and about 4% of the eighth composition.

3. The process of claim 2 wherein the step of heating includes heating the first, second, and third compositions to melted liquid states, and heating the fourth, fifth, sixth, seventh, and eighth compositions to melted liquid states separate from the first, second, and third compositions, and wherein the step of mixing includes mixing together the first, second, and third compositions to form a first mixture thereof, and mixing the fourth, fifth, sixth, seventh, and eighth compositions to form a second mixture thereof separate from the first mixture, and further comprising the step of blending the first and second mixtures together before the step of immersing.

4. The process of claim 3 wherein the step of heating the first, second, and third compositions includes raising and maintaining the temperature of the first, second, and third compositions between about 165° Fahrenheit to about 172° Fahrenheit, and the step of heating the fourth, fifth, sixth, seventh, and eighth compositions includes raising and maintaining the temperatures of the fourth, fifth, sixth, seventh, and eighth compositions between about 165° Fahrenheit to about 172° Fahrenheit.

5. The process of claim 4 wherein the step of mixing the first, second, and third compositions includes mixing them together for a period of about 20 minutes, and wherein the step of mixing the fourth, fifth, sixth, seventh, and eighth compositions includes mixing them together for a period of about 35 minutes.

6. The process of claim 5 wherein the step of blending all the compositions includes blending them together at a temperature between about 165° Fahrenheit to about 172° Fahrenheit for a period of about five minutes to about ten minutes.

7. The process of claim 6 wherein the step of immersing includes saturating the combustible material with the blended composition, and further comprising the step of cooling the removed combustible material to ambient temperature.

8. A chemically treated kindling produced in accordance with the process of claim 1.

9. A chemically treated kindling, comprising:

a combustible material saturated with a prepared composition, said prepared composition comprising a first composition comprising about 99% refined petroleum wax, about 1% refined oil, and not more than 15 parts per million of dibutylparacresol as an antioxidant; a second composition comprising about 87% refined petroleum wax and about 13% refined oil; a third composition comprising about 80% refined petroleum wax and about 20% refined oil; a fourth composition comprising about 75% refined petroleum wax and about 25% refined oil; a fifth composition comprising about 70% refined petroleum wax and about 30% refined oil; a sixth composition comprising about 95% refined petroleum wax and about 5% refined oil; a seventh composition comprising about 99% refined petroleum wax and about 1% refined oil; and an eighth composition comprising about 72% refined petroleum wax and about 28% refined oil.

10. The kindling of claim 9 wherein the percentages by weight of each said composition based on the total weight thereof are about 38% of said first composition, about 17% of said second composition, about 25% of said third composition, about 4% of said fourth composition, about 4% of said fifth composition, about 4% of said sixth composition, about 4% of said seventh composition, and about 4% of said eighth composition.

11. The kindling of claim 10 wherein said combustible material is pressed wood fibers.

12. The kindling of claim 11 wherein said combustible material is a pressed mixture of wood fibers, alum, and cornstarch.

13. The kindling of claim 12 wherein said combustible material, based on the total weight thereof, is about 92% by weight wood fibers, about 4% by weight alum, and about 4% by weight cornstarch.

* * * * *